US005395021A

United States Patent [19]

Brown

[11] Patent Number: 5,395,021

[45] Date of Patent: Mar. 7, 1995

[54] HANDGUN HOLSTER AND RETENTION BLOCK THEREFOR

[76] Inventor: Alvah B. Brown, 11136 Congress Rd., Lodi, Ohio 44254

[21] Appl. No.: 145,817

[22] Filed: Nov. 2, 1993

[51] Int. Cl.[6] ..... F41C 33/02

[52] U.S. Cl. ..... 224/244; 224/243; 224/911; 224/912

[58] Field of Search ..... 224/244, 243, 911, 913

[56] References Cited

U.S. PATENT DOCUMENTS

| | | | |
|---|---|---|---|
| 1,635,984 | 7/1927 | Corriston | 224/244 |
| 1,641,439 | 9/1927 | Jovino | 224/244 |
| 1,750,139 | 3/1930 | Swift | 224/244 |
| 2,551,913 | 5/1951 | Toby | 224/244 |
| 3,866,811 | 2/1975 | Hamby | 224/244 |
| 3,910,469 | 10/1975 | Baldocchi | 224/244 |
| 4,277,007 | 7/1981 | Bianchi et al. | 224/244 |
| 4,925,075 | 5/1990 | Rogers | 224/244 |
| 4,934,574 | 6/1990 | Salandre | 224/244 |
| 5,018,654 | 5/1991 | Rogers et al. . | |

*Primary Examiner*—Henry J. Recla
*Assistant Examiner*—David J. Walczak
*Attorney, Agent, or Firm*—Fay, Sharpe, Beall, Fagan, Minnich & McKee

[57] ABSTRACT

A handgun holster and retention block assembly that holds the handgun in a retained position by a spring biased trigger guard latch that is located under the sheath material of the holster to conceal it from view and reduce the possibility of unauthorized release.

7 Claims, 1 Drawing Sheet

HANDGUN HOLSTER AND RETENTION BLOCK THEREFOR

BACKGROUND OF THE INVENTION

The subject invention is directed toward a handgun retention device for incorporation in a holster.

Police, various law enforcement officials, and other persons required to carry handguns need holsters designed to prevent loss of the handgun from the holster either inadvertently during normal activities or through the intentional action of an unauthorized person. Many different retaining devices are known in the prior art. These prior art devices have incorporated various latches, straps, and the like intended to perform the retaining function. These devices have been somewhat unsatisfactory for a variety of reasons.

The typical prior art devices referred to above are shown and described in the following U.S. patents:

| Inventor | U.S. Pat. No. | Issue Date |
|---|---|---|
| Corriston | 1,635,984 | 07/19/27 |
| Jovino | 1,641,439 | 09/06/27 |
| Swift | 1,750,139 | 03/11/30 |
| Toby | 2,551,913 | 05/08/51 |
| Hamby | 3,866,811 | 02/18/75 |
| Baldocchi | 3,910,469 | 10/07/75 |
| Bianchi, et al. | 4,277,007 | 07/07/81 |
| Rogers | 4,925,075 | 05/15/90 |
| Salandre | 4,934,574 | 06/19/90 |
| Rogers, et al. | 5,018,654 | 05/28/91 |

SUMMARY OF THE INVENTION

A primary object of the invention is to provide an improved retention device which can function satisfactorily with a variety of holster designs and for many different handguns.

According to one aspect of the invention, a retention block apparatus is provided for use in a holster to retain a handgun with a trigger guard against undesired removal from the holster. The retention block apparatus generally includes a rigid frame having an elongated main body with first and second ends and a first exterior side surface that joins the ends. A U-shaped slot extends inwardly of the first exterior side surface from the first end to a point adjacent the second end. The slot has a width and depth adapted to substantially totally receive and enclose the trigger guard on the handgun. The frame further includes a rigid support member which extends away from the main body in general alignment with the U-shaped slot with a portion of the support member adapted to engage and position the barrel of the handgun when the trigger guard is in the slot. Mounted in the main body at a location adjacent the U-shaped slot is a latch with a portion of the latch being arranged for selective movement to a first latch position in the slot. An operating portion of the latch is accessible from the exterior of the main body for selectively moving the latch out of the slot.

Preferably, the latch is biased to the first position and is movable to a second position out of the slot by an operating portion that extends out of the main body of the frame. Additionally, the support member is preferably rigid throughout its length and extends at an angle to the second end of the main body.

In accordance with a preferred embodiment, the retention block, including both the main body and the support member, is formed from a resinous material as a unitary, one-piece structure. Also, the latch is preferably positioned in the main body for pivotal movement about an axis that is located laterally of, and generally parallel to, the slot.

In accordance with a further aspect of the invention, there is provided a handgun holster for a handgun having a barrel and a trigger guard. The holster includes a retention block member with a rigid main body having first and second ends joined by a first side surface and defining a U-shaped slot that extends from the first end toward the second end with an opening inwardly from the first side surface. The slot is sized to closely receive and enclose the handgun trigger guard. A rigid support member is joined to the main body and extends therefrom at an angle in general alignment with the U-shaped slot to a position wherein it can engage and support the barrel of the handgun when the trigger guard is in the slot. A latch is carried by the body portion and is located in the slot and movable between a first trigger guard engaging position and a second release position. Latch operating means are operable from the exterior of the main body for moving the latch between the first and second positions. Enclosing the retention block and defining the entrance end opening for receiving the handgun and guiding the trigger guard into the slot is a flexible cover which overlies the latch operating means to shield the operating means from visual observation while permitting manual operation thereof through the flexible cover portion.

The described holster and retention block apparatus makes it exceedingly difficult for an unauthorized person to remove the handgun from the holster. The latch operating portion of the retention device is totally shielded and concealed and only a person having full knowledge of the design arrangement of the holster can remove the handgun.

As can be seen from the foregoing, an object of the invention is the provision of a retention block apparatus and holster assembly which rigidly positions and holds a handgun to prevent inadvertent or unauthorized removal of the handgun from the holster assembly.

A further object of the invention is the provision of a retention block apparatus which can be incorporated into a variety of different holster shapes and designs and can be readily changed to permit use by either left-handed or right-handed persons.

Yet another object of the invention is the provision of a simple, rigid retention block assembly in which the retention latch mechanism is totally concealed when the block member is incorporated in a holster.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
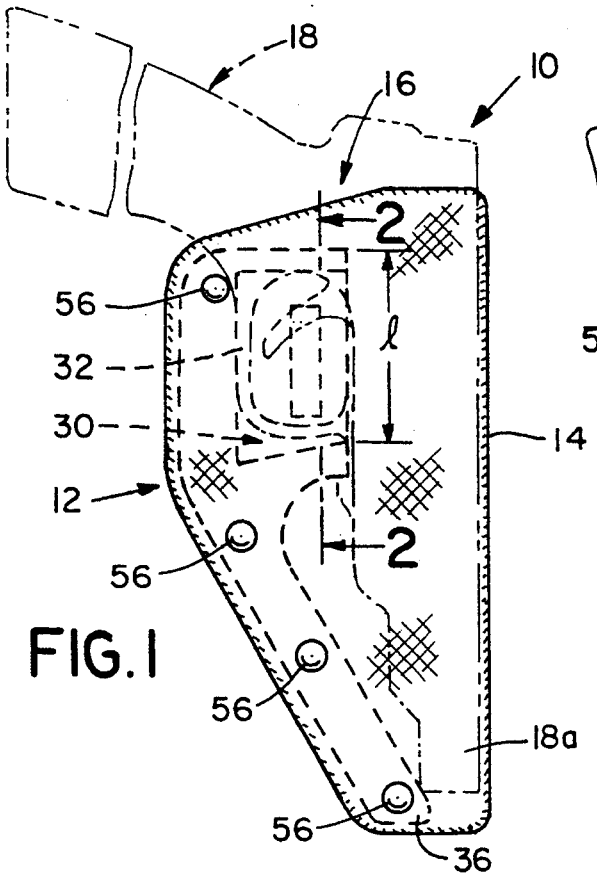
FIG. 1 is a side elevational view of a handgun holster incorporating the preferred form of retention block mechanism.

Referring more particularly to the drawings wherein the showings are for the purpose of illustrating a preferred embodiment of the invention only, and not for the purpose of limiting same, FIG. 1 shows the overall arrangement of a holster assembly 10 which incorporates the inventive retention block assembly 12. In the FIG. 1 showing, the holster includes a relatively flexible fabric or sheet sheath material 14 which encircles the retention block and provides an open upper end 16 which is sized and arranged so as to allow the handgun 18 (shown in phantom) to be inserted into the holster. The sheath material 14 is also arranged and shaped to guide the handgun into proper relationship with the retention block assembly 12.

Figure 2:
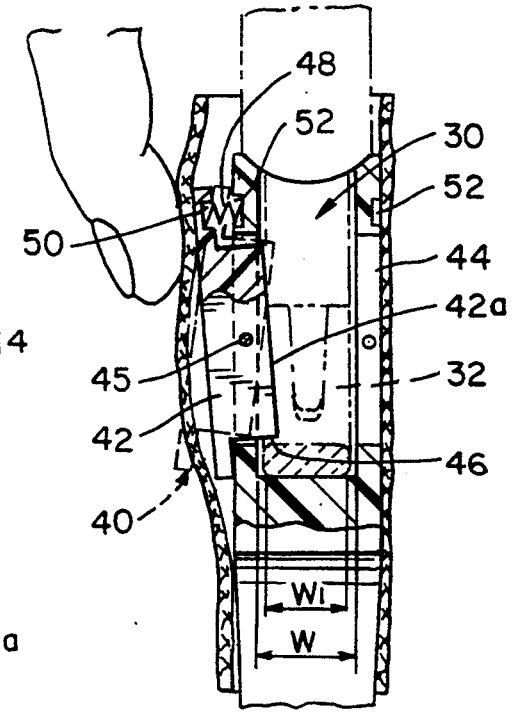
FIG. 2 is a partial cross-sectional view taken on lines 2—2 of FIG. 1 and showing the latch mechanism of the retention block assembly.
Figure 3:
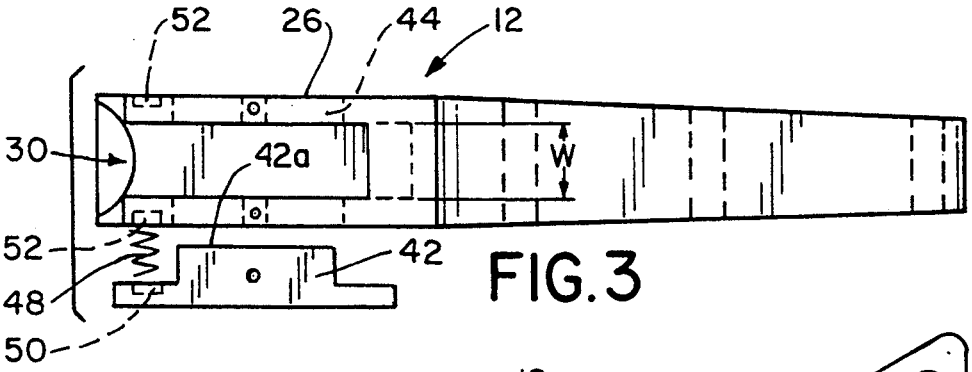
FIG. 3 is an exploded view of the retention block apparatus separate from the holster cover or sheath (the view is taken looking toward the trigger guard receiving slot portion); and, FIG. 4 is a side elevational of the trigger block mechanism of FIG. 3 without the latch member and with portions broken away to more clearly show certain design features.
Figure 4:
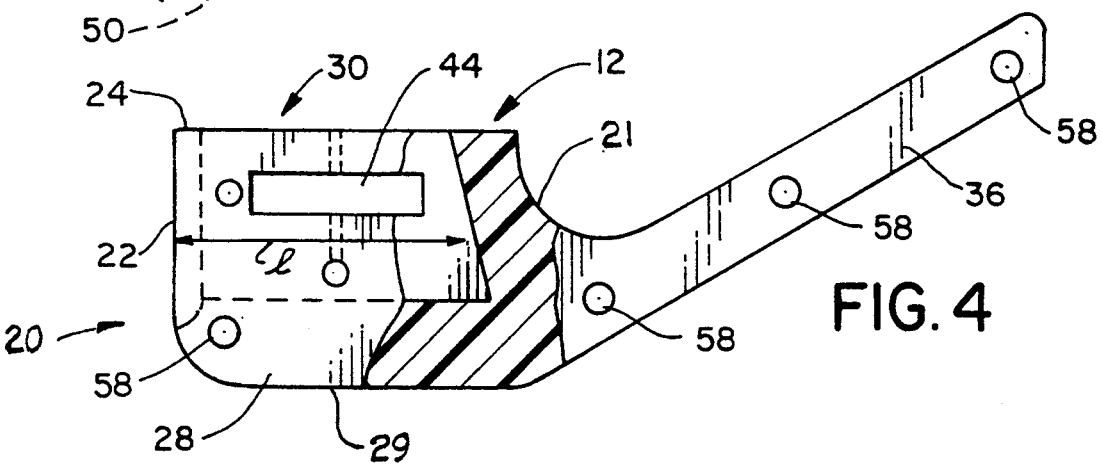

In the subject embodiment, the retention block assembly 12 comprises a main body section 20 which is formed from a suitable rigid material such as a plastic or resinous material like nylon, Delrin, high density polyethylene, or the like. As best illustrated in FIGS. 3 and 4, the main body section 20 is somewhat rectangular in configuration and includes a first end 21 and a second end 22 which are joined by a longitudinally extending, outer top or forward surface 24. A pair of generally parallel, lateral outer surfaces 26 and 28, and a bottom or rear surface 29 form the exterior of the body 20. Extending inwardly from end surface 22 and the first forward or top surface 24 is a slot 30 that is sized and arranged to closely receive and substantially totally enclose the trigger guard 32 of the handgun be that is intended to be retained in the retention block assembly 12 and holster 10. As shown in FIG. 1, the slot preferably has a length along surface 24 which is substantially as great as the longitudinal extent of the trigger guard 32. As illustrated in FIG. 2, the total width W of the slot 30 is only slightly wider than the width $W_1$ of the trigger guard. This assures that when the trigger guard is in position, it is closely guided and held by the slot 30.

Associated with the main body 20 and extending outwardly from the right-hand end thereof (as viewed in FIGS. 3 and 4) is a rigid support member 36. Member 36 is preferably integral with the body 20 and extends at an angle in the manner shown such that it can engage and position the barrel 18*a* of handgun 18 when the handgun is positioned with its trigger guard 32 suitably located within slot 30. This relationship is illustrated in FIG. 1 wherein the lower or outermost end of the barrel 18 engages and is supported by the end of the support 36. The combination of slot 30 and support 36 thus relatively rigidly mounts and supports the handgun 18.

Of particular importance to the invention is the arrangement for retaining and latching the handgun in position in the retention block assembly 12. As best illustrated in FIGS. 2 and 3, there is provided a retention latch arrangement 40 which comprises a latch member 42. Latch member 42 is formed from a rigid resinous material of the nature of that used for the retention block and has the configuration shown. The latch 42 has somewhat of a T-shape and is positioned to extend through a side slot 44 formed through the lateral side surfaces of the body 20. As shown in FIGS. 2 and 3, one of the openings or slots 44 is formed through each of the opposed lateral sides 26 and 28. As will become apparent, this allows the latch mechanism to be assembled into either side of the main body 20 so that the latch can be used by either a right-handed or left-handed person as desired.

As can be seen in FIG. 2, the latch 42 is arranged for pivotal movement about a pivot pin 45 which extends inwardly through suitable openings in a direction generally parallel to the slot 30 and positions the latch 42 for pivotal movement between a solid line latch position as shown and a dotted line position which permits removal of the gun from the retention block. Note that FIG. 2 illustrates the retention position in solid lines and, in this position, an inner retention corner latch portion 46 extends into the trigger guard and overlies the trigger guard to prevent removal of the handgun from the slot 30. The latch 42 is biased to the solid line latch position by a coil-type compression spring 48 that has its ends received in suitable circular openings 50 and 52 formed in the latch and retention block body 20, respectively.

As previously mentioned, the arrangement of the subject block and latch element is such that it can be shifted from the left side (as viewed in FIG. 2) to the right side so that it is capable of being operated, or it can be worn, in either the left of right side of the user. As can be seen, when the upper end of the latch is pushed inwardly to overcome the bias of the spring the lower latch corner 46 moves out of the trigger guard 32, and the gun may be removed from the retention block assembly 12 and the holster assembly 10.

Upon release of the latch after handgun removal, the latch returns to the solid line position. When the gun is re-inserted, the trigger guard engages the inner surface 42*a* of the latch and causes it to rotate clockwise (as viewed in FIG. 2) to permit the trigger guard to fully enter the slot 30 after which the latch automatically returns to the latch position shown solid.

The retention block and latch mechanism offers certain additional advantages in that the holster sheath or housing with which it is used can take a variety of different forms. Preferably, the assembly is used with the previously-mentioned fabric or thin, flexible sheet sheath that surrounds the retention block and defines the open upper end 16 which guides the handgun into the retention block. Preferably, the sheath 14 is retained in position relative to the retention block assembly 12 by, for example, suitable rivets or fasteners 56 which are received through openings 58 to retain the sheath on the retention block. In any event, the sheath 14 preferably overlies and conceals the latch mechanism and its operating portion from view. It is, however, thin and flexible enough, as well as sufficiently loose in the area over the latch, so as to permit free movement and operation of the latch.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A retention block apparatus for use in a holster to retain therein a handgun with a trigger guard against undesired removal from the holster, said apparatus comprising:

a rigid frame including an elongated main body having first and second ends with a first exterior side surface joining said ends;

a U-shaped first slot extending inwardly of the first exterior side surface from the first end to a point adjacent the second end, the slot having a width and depth adapted to substantially totally enclose the trigger guard on the handgun;

a second slot extending inwardly of the main body and opening into the U-shaped first slot;

the frame further including a rigid support member extending away from the main body in general alignment with the U-shaped first slot with a portion of the support member adapted to engage and position the barrel of the handgun when the trigger guard is in the U-shaped first slot;

a rigid latch member mounted pivotally in the second slot at a location adjacent the U-shaped first slot with a latch end portion of the latch member being arranged for selective movement to a first position in the U-shaped first slot to enter into the trigger guard when the trigger guard is in the U-shaped first slot; and, an operating portion of the latch member extending out of the second slot and accessible from the exterior of the main body for selectively moving the latch end portion out of the U-shaped first slot.

2. The retention block apparatus of claim 1 wherein the latch member is mounted for pivotal movement into and out of the U-shaped first slot through a lateral side thereof on a pivot pin carried in the main body.

3. The retention block apparatus as defined in claim 1 wherein the latch member is biased to the first position by a spring located in the main body and movable to a second position out of the slot by an operating portion that extends out of the main body.

4. The retention block apparatus as defined in claim 1 wherein the main body and the support member are formed from a resinous material.

5. The retention block apparatus as defined in claim 1 wherein the support member is rigid throughout its length and extends at an angle to the second end of the main body.

6. A handgun holster for a handgun having a barrel and a trigger guard, said holster comprising:

a retention block member with a rigid main body having first and second ends joined by a first side surface, a U-shaped first slot formed in the main body and extending from the first end toward the second end and opening inwardly from the first side surface, the U-shaped first slot having a size to closely receive and enclose the handgun trigger guard, a rigid support member extending away from the main body in general alignment with the U-shaped first slot with a portion of the support member adapted to engage and position the barrel of the handgun when the trigger guard is in the slot, a rigid latch member carried by the body portion in a second slot located in the main body and opening to the U-shaped first slot, said latch member movable between a first trigger guard engaging position and a second release position, and an end of the latch member comprising operating means operable from the exterior of the main body for moving the latch member between the first and second positions; and, a flexible cover means enclosing the retention block and defining an entrance end opening for receiving the handgun and guiding the trigger guard into the slot, said cover means overlying the latch operating means for shielding the operating means from visual observation while permitting manual operation thereof through the cover portion.

7. The handgun holster as defined in claim 6 wherein the retention block is joined to the cover means along one side thereof.

* * * * *